United States Patent [19]

Nusbaum

[11] Patent Number: 4,619,749

[45] Date of Patent: Oct. 28, 1986

[54] SYSTEM FOR EXTRACTING SILVER FROM LIQUID SOLUTIONS

[76] Inventor: Ronald C. Nusbaum, 12651 Hillcrest Dr., Longmont, Colo. 80501

[21] Appl. No.: 715,377

[22] Filed: Mar. 25, 1985

[51] Int. Cl.[4] ..... C25C 7/00; C25C 1/20

[52] U.S. Cl. ..... 204/228; 204/269; 204/271; 204/273; 204/109

[58] Field of Search ..... 204/228, 273, 109, 275, 204/269, 271

[56] References Cited

U.S. PATENT DOCUMENTS

| | | | |
|---|---|---|---|
| 3,450,622 | 6/1969 | Cothran | 204/228 X |
| 3,551,318 | 12/1970 | Snook et al. | 204/228 |
| 3,751,355 | 8/1973 | Mandroian | 204/228 |
| 3,875,032 | 4/1975 | Thompson | 204/109 |
| 3,925,184 | 12/1975 | Cave | 204/229 |
| 3,926,771 | 12/1975 | Lieb et al. | 204/273 X |
| 3,959,110 | 5/1976 | Burgess | 204/229 |
| 4,018,658 | 4/1977 | Alfin et al. | 204/109 |
| 4,054,503 | 10/1977 | Higgins | 204/271 |
| 4,127,465 | 11/1978 | Higgins | 204/228 |
| 4,263,108 | 4/1981 | Berg et al. | 204/109 |
| 4,302,318 | 11/1981 | Mock | 204/229 |
| 4,319,971 | 3/1982 | Good et al. | 204/109 |

*Primary Examiner*—Donald R. Valentine

*Attorney, Agent, or Firm*—Harvey B. Jacobson

[57] ABSTRACT

Ionic silver is extracted from photographic fixing solutions by electrolytic plating on a removably fixed cathode plate of an electrode assembly connected in series with a fixed resistor to a voltage source from which plating current is drawn. The plating current is correctively changed by detection logic in response to excessive variation in the electrolytic resistance of the liquid beyond a threshold limit established through a programmed reference voltage generator that is calibrated to match the chemistry of the particular liquid being electrolytically processed.

17 Claims, 7 Drawing Figures

SYSTEM FOR EXTRACTING SILVER FROM LIQUID SOLUTIONS

BACKGROUND OF THE INVENTION

This invention relates to electrolytic extraction of ionic silver from photographic, liquid fixing solutions.

The recovery of silver by electrolysis from photographic fixing solution is already well known and many systems of this type have been devised in an effort to process large quantities of liquid in a more efficient and less costly manner. However, prior systems and apparatus are characterized by various problems and disadvantages such as heavy equipment components, costly maintenance, high energy consumption and most importantly restriction of operational efficiency to a narrow range of liquid chemical properties.

The foregoing type of silver extraction apparatus usually includes a liquid tank within which an electrode assembly is suspended including at least one electrode on which the silver is electrolytically plated in response to plating current conducted through the liquid between electrodes from some source of electrical plating voltage. To enhance the electrolytic action, bladed impellers are sometimes used to agitate or augment flow of the liquid as disclosed in U.S. Pat. Nos. 4,302,318 and 4,319,971, while exhaust fans are provided for cooling purposes as disclosed in U.S. Pat. No. 4,127,465. Current control systems have been proposed to vary the plating current in order to maximize silver recovery as disclosed in U.S. Pat. Nos. 3,551,318, 3,751,355, 3,875,032, 3,925,184, 3,959,110, 4,018,658, and 4,263,108. The use of two recovery tanks through which the liquid is repetitiously processed in series, has also been proposed in U.S. Pat. Nos. 4,127,465 and 4,302,318.

It is an important object of the present invention to provide a less costly and more efficient electrolytic silver recovery apparatus which is capable of being operated with maximum efficiency for a wide variety of ionic silver containing liquids having different mineral contents, chemical composition and electrochemical properties that have heretofore affected efficient use.

An additional object of the present invention is to provide apparatus of the foregoing type which is capable of being programmed for use with optimum efficiency within threshold limits established in accordance with the particular chemistry of the liquid being processed.

SUMMARY OF THE INVENTION

In accordance with the present invention, liquid flows in sequence through two compartments of a tank in opposite directions relative to opposite sides of fixed removable plate cathodes, at a boundary layer disrupting flow rate. Primary silver extraction occurs in one compartment within which primary electrodes are connected in series with a fixed resistor to reduce plating current from a voltage source that is controlled for optimum silver extraction from the liquid between ion concentration limits established by selection of operational parameters matching the particular chemistry of such liquid. Secondary recovery of silver is effected within the other tank compartment through secondary electrodes acting in a scavenging mode with a different adjusted plating current.

According to one embodiment, the primary plating current is automatically changed in a corrective direction when the electrolytic resistance of the liquid reaches a threshold limit recognized by detector logic programmed through a reference voltage generator in accordance with a calibrating procedure for matching the liquid chemistry.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENT

Figure 1:
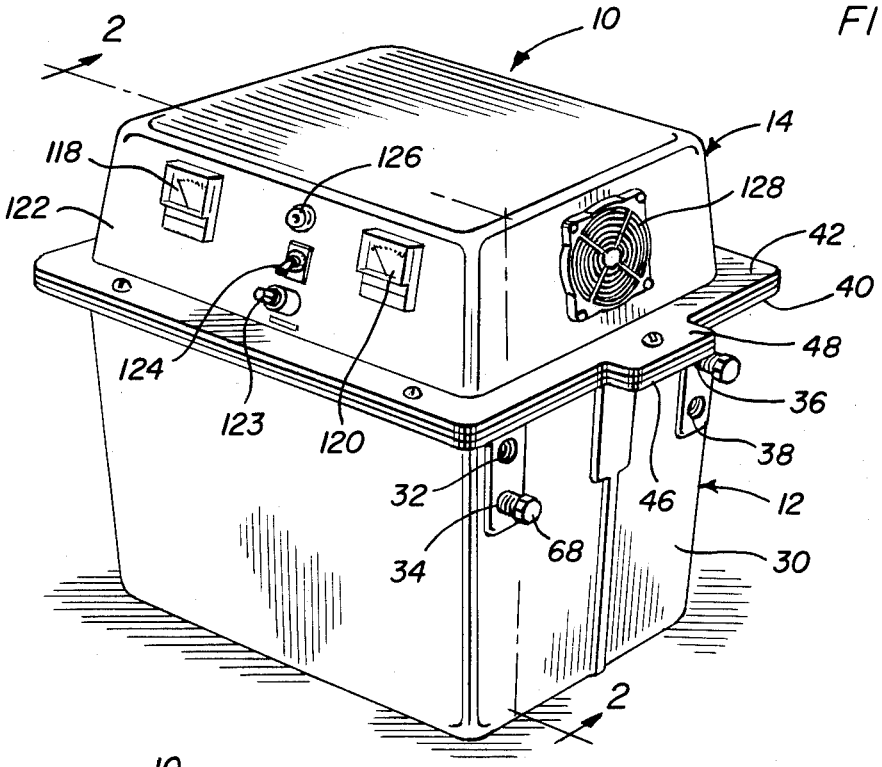
FIG. 1 is a perspective view showing a silver recovery apparatus in accordance with one embodiment of the invention.
Figure 2:
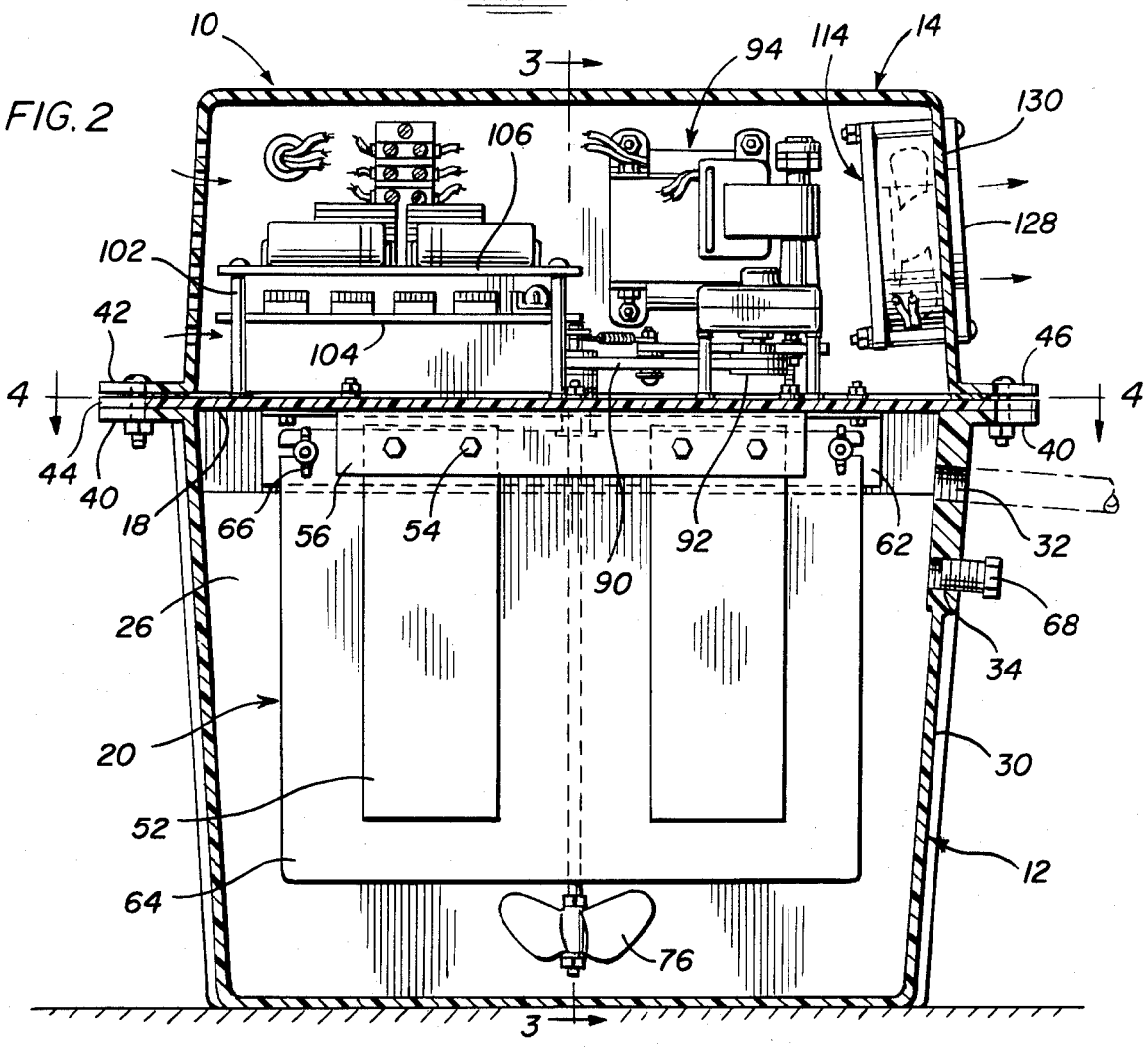
FIG. 2 is a side sectional view taken substantially through a plane indicated by section line 2—2 in FIG. 1.
Figure 3:
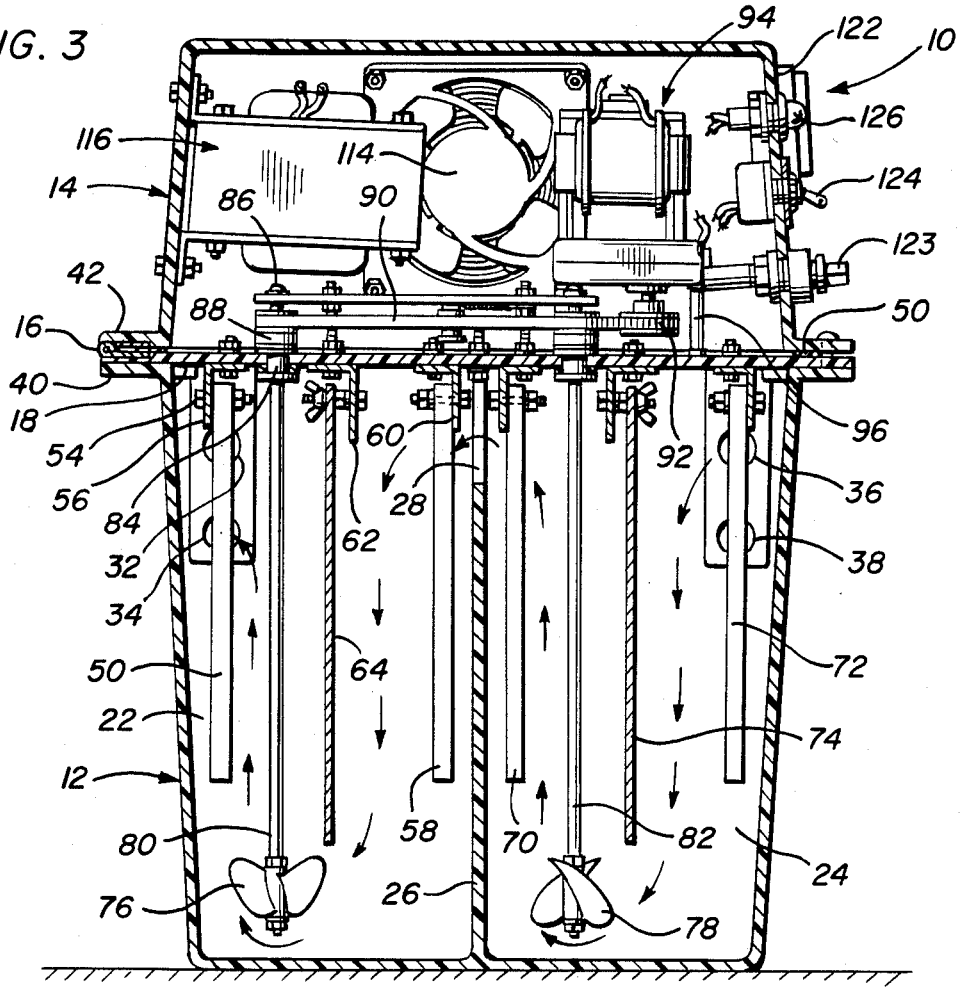
FIG. 3 is a sectional view taken substantially through a plane indicated by section line 3—3 of FIG. 2.

Referring now to the drawings in detail, the apparatus of the present invention generally referred to by reference numeral 10 in FIGS. 1–3 features a tank or housing 12 open at the top, but adapted to be closed by a cover 14 pivotally mounted on the housing by a hinge 16. The hinge also pivotally connects the cover to a planar support base 18 from which an electrode assembly 20 is suspended within the tank 12. The electrode assembly occupies two compartments 22 and 24 within the tank separated by a partition wall 26. A flow connecting passage notch 28 is formed on the upper edge of the partition wall adjacent end wall 30 of the tank within which a pair of internally threaded fluid outlet ports 32 and 34 are formed spaced from partition wall 26 on one side. A pair of fluid inlet ports 36 and 38 are also formed in the end wall 30 on the opposite side of the partition wall. The tank 12 may be reassembled relative to the cover 14 by 180° so that the inlet and outlet roles of the ports are reversed and provide access to liquid supply and exhaust plumbing at either longitudinal end of the apparatus.

The support base 18 is sandwiched between confronting peripheral flanges 40 and 42 of the tank 12 and cover 14 as shown in FIGS. 1–3. Opposite longitudinal ends of the support base 18 have lift tabs 44 projecting therefrom in abutting alignment with lock tabs 46 and 48 on the flanges 40 and 42, respectively, of the tank and cover. Aligned holes are formed in the tabs 44, 46 and 48 for receiving the shanks of locking elements adapted to hold the cover 14 and the base 18 sealed on the flange 40 of the tank. A peripheral sealing strip 50 is fixed to the cover flange 42 as more clearly seen in FIG. 3 for contact with the base 18.

The electrode assembly 20 suspended from support base 18 includes a pair of longitudinally spaced anode bars 52 permanently secured by fasteners 54 to an angle bar 56 fixed to the underside of the base 18. A second pair of longitudinally spaced anode bars 58 are similarly fastened to angle bar 60 fixed to the underside of base 18 on one side of a parallel spaced angle bar 62. A single cathode plate 64 is removably secured by wing nut fasteners 66 to the angle bar 62. The cathode plate 64 extends longitudinally between and beyond the anode bars 52 and 58 and vertically therebelow within compartment 22 to form electrodes immersed in electrolytic liquid adapted to fill the compartment 22 through one of the ports 32 and 34, the other of such ports being closed by a plug 68. The liquid flows between compartment 5 through passage 28 from which it exits through one of the outlet ports, the other of the outlet ports being closed by another plug 68. A second set of anode bars 70 and 72 and intermediate cathode plate 74 are suspended from base 18 within compartment 24 to form electrodes.

Figure 4:
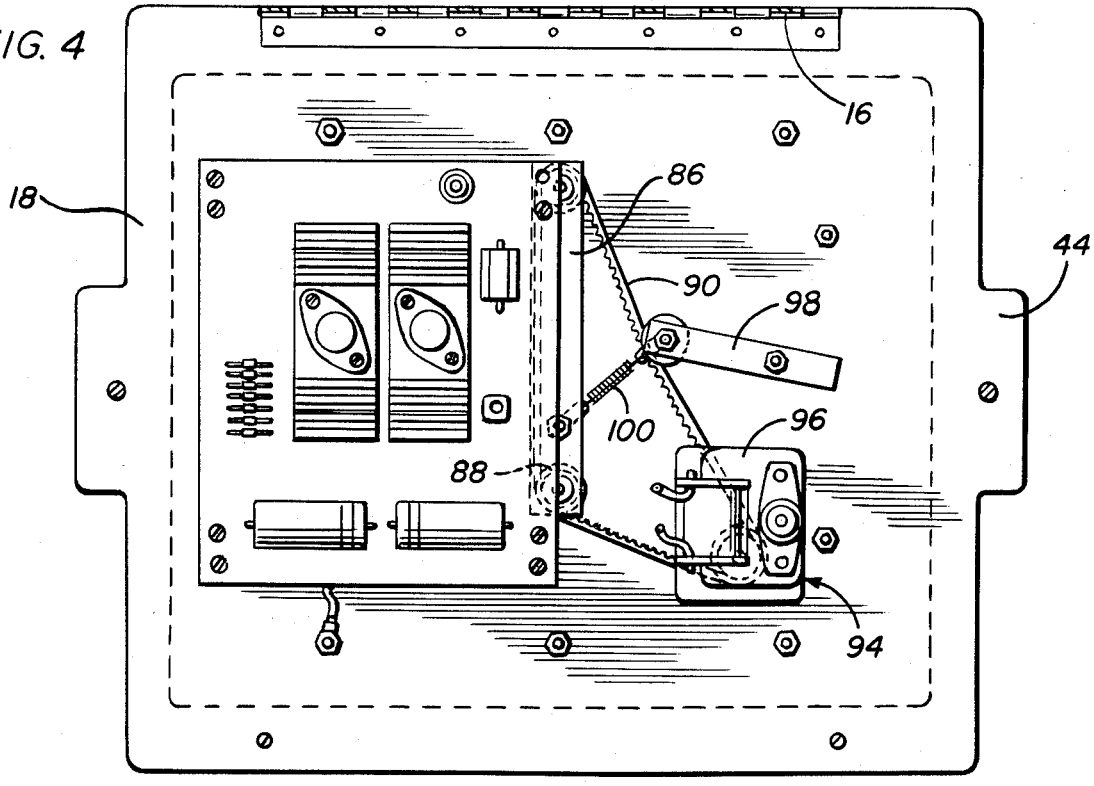
FIG. 4 is a top sectional view taken substantially through a plane indicated by section line 4—4 in FIG. 2.

A pair of bladed impellers 76 and 78 as more clearly seen in FIG. 3 are respectively positioned within the compartments 22 and 24 just below the cathode plates 64 and 74 closer to the partition wall 26 and the side tank wall on sides opposite the ports. The impellers are connected to the lower ends of impeller shafts 80 and 82 journaled by spaced bearings 84 extending through the base 18 from a bearing support bar 86 fixed to the base in spaced relation thereabove as more clearly seen in FIGS. 2 and 3. Pulley wheels 88 are fixed to the upper ends of the impeller shafts 80 and 82 below the support bar 86. An endless drive belt 90 is entrained about the driven pulleys 88 and a drive pulley 92 to form a drive connection to the impeller shafts from the output shaft of a drive motor 94 supported above the base 18 by support bracket 96. A belt tightener 98 is engaged with the drive belt 90 under the bias of spring 100 to impart rotation to the impellers 76 and 78 when drive motor 94 is energized as more clearly seen in FIG. 4.

Also mounted above the base 18 and fixed thereto by support posts 102 are a pair of verticaly spaced circuit boards 104 and 106 on which various circuit components and wiring are mounted, such circuitry to be described hereinafter in detail. Other components of the circuitry are mounted within the cover 14 as more clearly seen in FIGS. 2 and 3, including the motor 114 of an exhaust fan, a power transformer 116 and ammeters 118 and 120 exposed on one sidewall 122 of the cover 14. A fuse 123 is also mounted on the sidewall 122 between the meters in the illustrated embodiment adjacent a power switch 124 and a power indicator lamp 126. The exhaust fan is exposed through an opening grill 128 on the end wall 130 of the cover to vent gases and heat evolved from the processing of liquid in tank 12.

Figure 5:
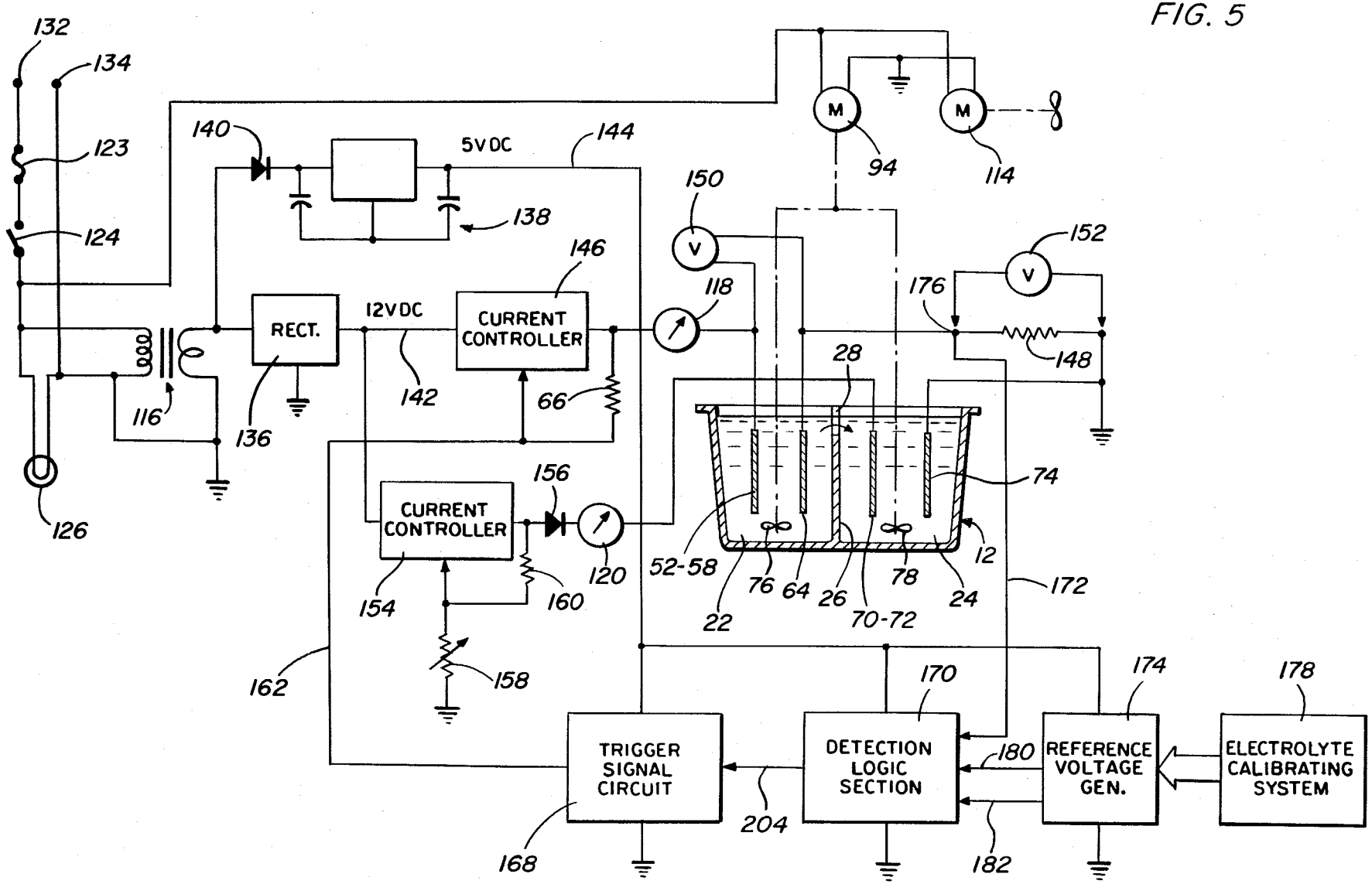
FIG. 5 is a schematic block circuit diagram illustrating the system of the present invention in accordance with the embodiment shown in FIGS. 1–4.

The apparatus 10 as hereinbefore described with respect to FIGS. 1–4, is schematically depicted in FIG. 5 together with its circuit control system. As shown, a body of electrolytic liquid occupies the tank compartments 22 and 24 through which the liquid flows in sequence between the inlet and outlet ports under a gravity head. Flow within the tank compartments is directed by the impellers 76 and 78 when motor 94 is energized so as to obtain a predetermined liquid flow pattern relative to the primary and secondary electrodes as will be described in detail hereinafter. The impeller drive motor 94 as well as the exhaust fan motor 114 are energized upon closing of the power switch 124 to connect such motors in parallel through fuse 124 to a conventional source of AC voltage at power terminals 132 and 134. Closing of power switch 124 also energizes the indicator lamp 126 and the power transformer 116 from which a lower output voltage of 12 VAC for example, is applied to a voltage rectifier 136 and to a constant voltage regulator 138 through current rectifying diode 140. A rectified voltage of 12 VDC is accordingly established in power supply line 142 from which a DC plating current is drawn, while a constant operational voltage of 5 VDC is established in voltage supply line 144. Plating current is supplied from line 142 under control of a current controller 146 to the primary anodes 52–58 in series with ammeter 118. The plating current is conducted through the electrolytic liquid to one of the cathodes 64 for example connected through a voltage reducing resistor 148 to ground to complete the plating circuit. As is already well known in the art, the foregoing plating circuit causes electrolytic deposition of metallic silver on the cathode 64. The rate of deposition and thoroughness of the electrolytic silver extracting operation will depend on various electrochemical factors such as the silver ion concentration within the liquid, the electrolytic resistance of the liquid and the plating current. In accordance with the present invention, the level of the plating current may be correctively changed through the adjusting terminal of current controller 146 from which an output voltage is applied to the primary anodes 52–58. The plating current conducted to the primary electrodes is monitored through ammeter 118. The voltage drop across the primary electrodes is monitored through a voltmeter 150, while the volt-drop across the resistor 148 is monitored by a voltmeter 152 for purposes to be explained hereinafter.

The secondary electrodes 70–72 and 74 in the tank compartment 24 are connected in parallel to the voltage line 142 through a second current controller 154, similar to controller 146, in series with diode 156 and the ammeter 120. The electrolytic action of the secondary electrodes in response to a different plating current recovers additional silver not extracted by the primary electrodes as the liquid flows in sequence through the compartments 22 and 24. Current controller 154 is adjusted for secondary scavenging purposes through a grounded, manually adjustable resistor 158 connected to the adjustment terminal of the current controller to which a feedback resistor 160 is connected. Adjustment of the primary current controller 146, on the other hand, is effected automatically for optimum primary extraction of silver in accordance with one embodiment of the present invention through a signal line 162 connected to the adjustment terminal of the current controller 146 and a feedback resistor 166.

The signal line 162 extends from the output of a trigger circuit 168 generating a corrective switching signal in response to an output from a detection logic section 170. The detection section 170 compares inputs from the electrode assembly in line 172 with one of two inputs from a reference voltage generator 174 in order to detect a threshold condition of the liquid undergoing electrolytic action to extract silver of the electrode assembly. For that reason, input line 172 is connected to the voltage dividing junction 176 between the fixed resistor 148 and the cathode 64. The input potential in line 172 will reflect both the instantaneous silver ion concentration in the liquid and its electrolytic chemistry between threshold conditions matched by potentials in lines 180 and 182 from the reference voltage generator 174. Operating voltage for components 168, 170 and 174 is supplied from the regulated voltage line 144. An electrolyte calibration system 176 is associated with the reference voltage generator 174 to program the reference voltage outputs to the detection logic section 170 in order to accommodate electrolytic liquids of widely differing chemistry.

Figure 6:
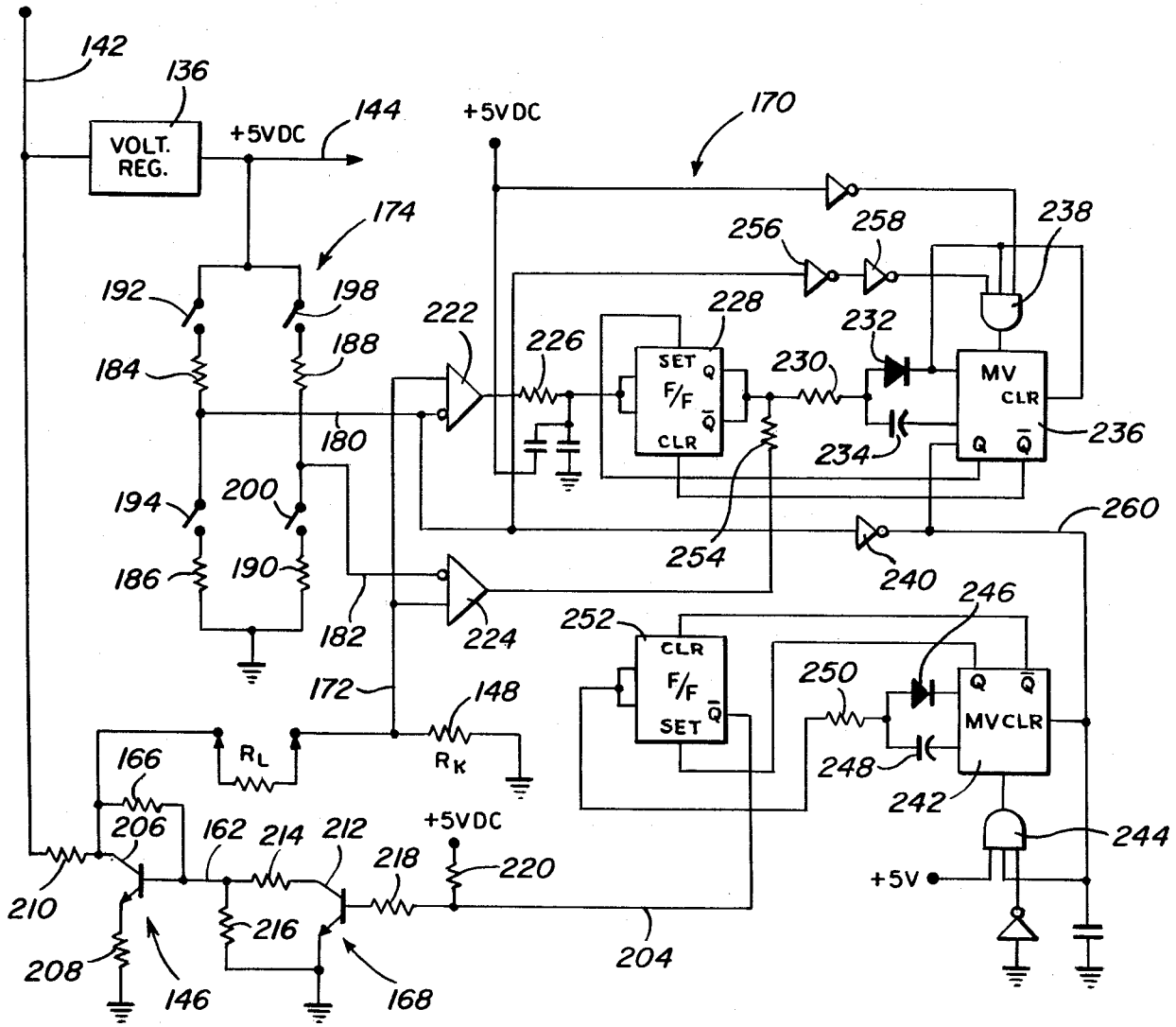
FIG. 6 is an electrical circuit diagram corresponding to the system depicted in FIG. 5.

FIG. 6 illustrates in greater detail the circuitry associated with the apparatus 10 pursuant to one specific embodiment of the invention, wherein the electrolytic resistance of the current path through the liquid between the primary electrodes is represented as ($R_1$) while the resistance of fixed resistor 148 in series therewith is represented as ($R_k$). The total plating voltage (V) applied to the primary electrode circuit will accordingly be: $(I_p)(R_1+R_k)$, where ($I_p$) is the plating current and the volt drop across the primary electrodes is $(I_p)(R_1)=R_1/R_1+R_k$. Thus, the apparatus parameters, such as the fixed value ($R_k$) for resistor 148 and the ratio of anode to cathode surface area for the primary electrodes are selected to provide optimum electrolytic extraction of silver under given threshold conditions of ion concentration in the liquid. The total voltage applied (V), on the other hand, is varied by means of the controller 146 to accommodate the chemistry of the liquid reflected by the volt drop across the electrodes which is sensed as a threshold potential at the voltage dividing junction 176 in accordance with the present invention. Such threshold potential is a function of ($R_1$) corresponding to the factor $R_1/R_1+R_k$ since the volt drop is (V) $R_1/R_1+R_k$ as aforementioned. The junction 176 is connected to one input of the detection circuit 170 by line 172 for comparison with liquid chemistry matching inputs from the reference voltage generator 174 in lines 180 and 182.

Figure 7:
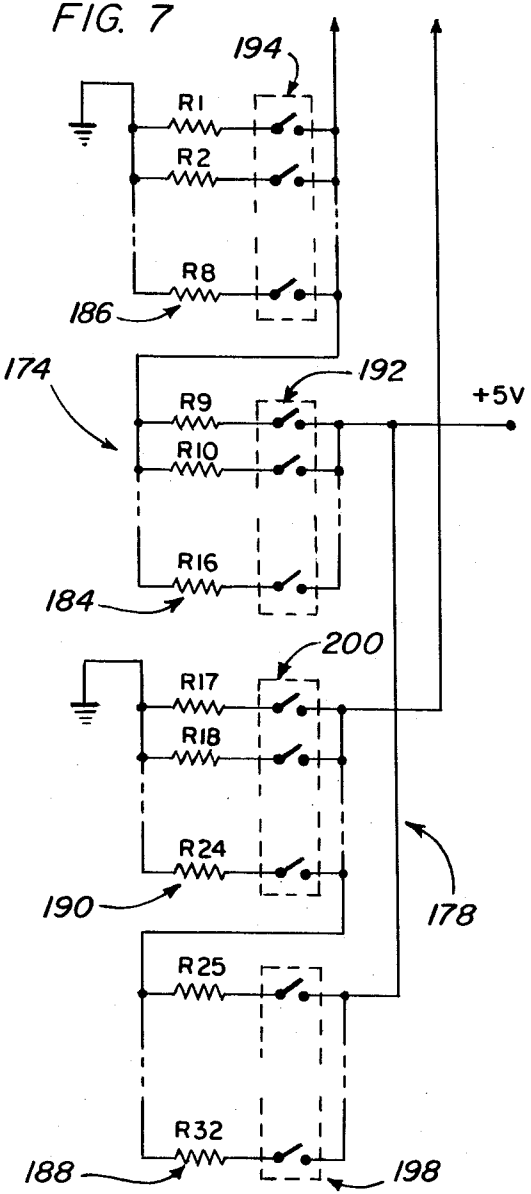
FIG. 7 is a circuit diagram illustrating the reference voltage generator of FIGS. 5 and 6 in greater detail.

As shown in FIG. 6, the reference voltage generator 174 includes two voltage dividing resistance branches formed by equivalent resistors 184, 186, 188 and 190. The resistors 184 and 186 are interconnected in series between the regulated voltage line 144 and ground through equivalent switches 192 and 194 to apply a voltage dividing input at junction 196 to the input line 180 from one of the branches. The other parallel branch of the reference voltage generator is established by closing of equivalent switches 198 and 200 to interconnect the resistors 188 and 190 in series between the regulated voltage line 144 and ground. Input line 182 is connected to the junction 202 between the resistors 188 and 190. The reference voltage input at junction 196 or 202 will be ($V_r$) $R_x/R_x+R_y$, where ($V_r$) is the regulated voltage, ($R_x$) is the equivalent resistance of resistor 184 or 188 and ($R_y$) is the equivalent resistance of resistor 186 or 190. The reference voltage factor ($R_x/R_x+R_y$) is selected to match the aforementioned threshold potential factor $R_1/R_1+R_k$ under different ion concentration conditions of the liquid by selection of one of the junctions 196 and 202 as the operative input to the detection logic section 170 through the switches 192, 194, 198 and 200 which form part of the electrolyte calibration system in accordance with one embodiment of the invention. The value of the resistances ($R_x$) of resistor 184 or 188 and ($R_y$) of resistor 186 or 190 is also selected by the electrolyte calibration system to obtain a matching factor $R_x/R_x+R_y$ as will be apparent from FIG. 7 showing the reference voltage generator 174 and electrolyte calibration system 178 in greater detail. The equivalent switches 192 and 198 are respectively formed by banks of eight switches connected in parallel to the regulated voltage line 144, each switch being connected to a resistor to form two banks of eight resistors interconnected in parallel to the junctions 196 and 202 to form the equivalent resistors 184 and 188 as depicted in FIG. 6. Similarly, banks of eight resistors are interconnected in parallel to ground to form the equivalent resistors 186 and 190, each of the bank resistors being connected by one switch of a bank of eight switches to the junctions 196 and 202 to form the equivalent switches 194 and 200 aforementioned. Closure of different combinations of switches will accordingly form the equivalent resistance ($R_x$) and ($R_y$) for each branch as depicted in FIG. 6 as well as the branch to be activated. According to an actual embodiment of the invention, only combinations of two or three switch closures was found necessary to produce the necessary number of selections for matching threshold potentials at junction 176 under two liquid threshold conditions representing lower and upper ion concentration limits. It will, of course, be appreciated that many more matching selections could be made by increasing the number of switch closure combinations that are available from the arrangement shown in FIG. 7, to accommodate additional threshold conditions intermediate the lower and upper limits.

With reference to FIGS. 6 and 7, the reference voltage generator 174 is deactivated by opening of all switches associated therewith. Both switches 194 and 200 are closed as part of a start-up, calibrating procedure wherein resistors 186 and 190 simultaneous apply above ground calibrating potentials to the detection section 170 while the apparatus undergoes an electrolytic operation with a liquid under known low ion concentration condition. Switch 200 is then opened and the volt drops across the primary electrodes and the resistor 148 are measured by means of the voltmeters 150 and 152 in order to calculate the threshold potential factor $R_1/R_1+R_k$ as aforementioned. The reference voltage generator 174 may then be manually set through the equivalent switches 192, 194, 196 and 198 as aforementioned to produce a matching reference output factor $R_x/R_x+R_y$ by selection of a switch closure combination from an appropriate chart. A similar start-up calibrating procedure is utilized for an upper threshold limit condition of the liquid, except that only switch 194 is then closed to apply a calibrating potential on the input line 182 to the detection logic section 170 before measurement, calculation and matching of the corresponding threshold potential factor.

Once calibrated, the detection logic section 170 will generate a switching signal, either in response to a decreasing plating current approaching the lower threshold limit established, or in response to an increasing plating current approaching the upper threshold limit established. When the detection logic 170 is programmed for recognition of the lower threshold limit switches 192 and 194 are closed thereafter to activate only input line 180 to detect approach of the electrolytic resistance at cathode junction 176 to the lower established threshold limit and thereby generate an output from the detection logic section 170 that is applied by output line 204 to the trigger signal circuit 168 causing the current controller 146 to reduce the applied voltage and plating current. When programmed for recognition of the upper threshold limit, switches 198 and 200 are closed to activate only input line 182 so that detection logic section 170 will sense excessive increase in plating current approaching the upper threshold limit to cause an increase in the applied voltage and plating current.

The optimum silver extracting operation of apparatus 10 is thereby automatically prolonged.

The circuit for current controller 146 as shown by way of example in FIG. 6 includes a transistor 206 having an output collector connected to the primary anode 52–58, a base connected at the adjusting terminal to signal line 162 from the trigger circuit 168 and an emitter connected to ground through resistor 208. Feedback resistor 166 is interconnected between the collector and base. A heat dissipating load resistor 210, exposed to a cooling airflow within cover 14, interconnects the voltage line 142 with the output collector of transistor 206. The transistor 206 is normally held in a non-conductive state by a cut-off bias applied to its base from the detection section 170 in its low threshold mode aforementioned. The voltage applied to the primary electrodes from line 142 will then be determined only by the volt drop across the load resistor 210. A switching input applied to the base of transistor 206 will switch it to a conductive state so as to establish therethrough a parallel path to ground through the emitter resistor 208 thereby reducing the plating current as aforementioned. When the detection section 170 is in its upper threshold mode as aforementioned, the trigger circuit 168 will normally hold a bias on the base of transistor 206 so that a relatively low plating current is conducted through the electrode assembly. The transistor 206 will therefore be switched to a non-conductive state when the upper threshold limit of ion concentration in the liquid is reached to increase the plating current.

The trigger circuit 168 in the embodiment shown in FIG. 6 includes a transistor 212 having an output collector connected by resistor 214 to the switching signal line 162, a ground emitter connected to a feedback resistor 216 and a base connected by resistor 218 to the signal output line 204 from the detection logic section 170. The regulated voltage source in line 144 is connected through resistor 220 to the line 204 so as to maintain a constant bias on the base of transistor 212 that is increased to a cut-off level or decreased to a switch-on level by directional changes in the output logic state of line 204 from the detection logic section 170.

The detection logic section 170 includes a pair of comparators 222 and 224. The inverting input of comparator 222.and the non-inverting input of comparator 224 are interconnected in parallel by line 172 to the cathode junction 176 to receive an input that is a function of a variable electrolytic resistance ($R_1$), namely ($R_1/R_1+R_k$) as aforementioned. The non-inverting input of comparator 222 has a reference input applied thereto by output line 180 from the reference voltage generator 174 while the inverting input of comparator 224 has a different reference input applied thereto through line 182. The reference input selection as aforementioned is programmed by the calibration system 178 to respectively match the electrolytic resistance at the lower and upper threshold limits of the liquid and set the logic in a corresponding threshold detection mode.

In the lower threshold detection mode, reference input line 180 is activated so that only comparator 222 will respond to a threshold input at junction 176 by applying a switching pulse through resistor 226 to a flip-flop 228 to effect a logic change in the state of its outputs. The outputs of flip-flop 228 are coupled by resistor 230, diode 232 and capacitor 234 to a retriggerable monostable multivibrator 236 that is triggered by the output of an AND gate 238 having one input interconnected with the clear terminal of the multivibrator 236 and its input terminal to which the diode 232 is coupled. The reference voltage line 180 is also coupled by an inverter 240 to the clear terminal of a second retriggerable, monostable multivibrator 242 and one input of its associated AND gate 244. The multivibrator 242 is coupled by diode 246, capacitor 248 and resistor 250 to the input terminals of a second flip-flop 252 having one operational output terminal connected to the switching signal line 204. The set and clear terminals of both flip-flops 228 and 252 are respectively connected to the pulse output terminals of the multivibrators 236 and 242. By virtue of the foregoing arrangement, the logic section 170 will be set in one detection mode by the reference voltage in line 180 matching the low threshold limit potential. When the input at junction 176 exceeds the reference voltage input in line 180, the comparator 222 produces an output applied through resistor 226 to the flip-flop 228 causing its outputs to change logic state and apply a positive going pulse through resistor 254, and inverters 256 and 258 to an input of AND gate 238. An output of multivibrator 236 is thereby generated in line 260 connected to an input of AND gate 244 to trigger an output from multivibrator 242 which is applied through resistor 250 to flip-flop 252. The output of flip-flop in line 204 accordingly changes logic state in one direction to apply a switching signal to the trigger circuit 168 as aforementioned.

In the upper threshold limit setting of the reference voltage generator 174, only the reference voltage on line 182 is applied to the inverting input of comparator 224 with the logic section 170 conditioned for a corresponding threshold detection mode. In this upper threshold operational mode, an output from comparator 224 is directly applied through inverters 256 and 258 to one input of AND gate 238 in order to produce a change in logic state in output line 204 from flip-flop 252 in the other direction from that produced in the lower threshold mode.

As more clearly seen in FIG. 3, optimum electrolytic silver extraction from the liquid between the threshold limits is achieved by the impellers 76 and 78 inducing flow in opposite vertical directions on opposite sides of the cathode plates 64 and 74 between the inlet and outlet ports by virtue of the location of the impellers relative to the ports, the electrodes and compartment partition 26. The rotational speeds of the impellers is such as to induce flow at a rate necessary to overcome the Nernst boundary that would otherwise surround the cathode plates during the plating action. Further, for certain liquid chemistries, such as EP-2 type bleach fixers the anode to cathode surface area ratio found to be critical in obtaining such optimum silver extraction, is between 1.93 to 2.35. For other liquid fixers, the anode to cathode surface area ratio should be between 0.87 and 1.05. Substantially complete silver extraction is also achieved by manual adjustment of the current controller 154, for the plating current conducted between the secondary electrodes 70–72 and 74 during the scavenging operational phase within the tank compartment 24. Automatic adjustment for the secondary current controller 154 is, of course, contemplated as well as the use of programmed computer facilities for manipulating the various switches associated with the electrolyte calibration system 178 as hereinbefore described.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with apparatus for recovering metal from a body of electrolytic liquid conducting plating current therethrough between at least two electrodes including current control means connected to one of the electrodes for changing said plating current supplied thereto from a voltage source, means connected in series with the other of the electrodes for establishing an electrode potential on the other of the electrodes dependent on resistance characteristics of the liquid, the improvement comprising voltage selection means connected to said source for selectively generating a reference threshold potential substantially equal to said electrode potential under a predetermined threshold condition of the liquid, detector means connected to said other of the electrodes and the voltage selection means for comparing the electrode potential with said reference threshold potential and means coupling the detector means to the current control means for prolonging recovery of metal by corrective change in the plating current in response to substantial matching of the potentials being compared by the detector means as the liquid approaches the predetermined threshold condition.

2. The combination of claim 1 including a tank within which said body of liquid is enclosed, means dividing said tank into primary and secondary compartments, means for conducting flow of the liquid from the primary compartment into the secondary compartment, said two electrodes being enclosed within the primary compartment, and a second pair of electrodes enclosed within the secondary compartment between which plating current is conducted by the electrolyte.

3. In combination with apparatus for recovering metal from a body of electrolytic liquid conducting plating current therethrough between electrodes including current control means connected to one of the electrodes for changing said plating current supplied thereto from a voltage source, the improvement comprising resistor means connected in series with the electrodes for establishing a threshold potential on the other of the electrodes dependent on resistance characteristics of the liquid under a predetermined threshold condition, voltage selection means connected to said source for producing a reference potential substantially matching said threshold potential, detector means connected to said other of the electrodes and the voltage selection means for generating a switching signal in response to approach of the liquid to said predetermined threshold condition, and means coupling the detector means to the current control means for prolonging recovery of the metal by corrective change in the plating current in response to said generation of the switching signal, the voltage selection means including a resistance network connected to the voltage source having at least two parallel voltage dividing branches, and selection switch means connected to said resistance network for connecting one of the voltage dividing branches to the detector means and for selecting the resistance thereof.

4. The improvement as defined in claim 3 including secondary electrodes connected in parallel with the first mentioned electrodes to said voltage source and impeller means for inducing flow of the liquid sequentially between the first mentioned and secondary electrodes.

5. The combination of claim 4 wherein said electrodes include removable plate cathodes on which the metal is plated.

6. The combination of claim 5 wherein the liquid is enclosed within a container having a partition separating two compartments, the first mentioned and secondary electrodes being respectively suspended within the two compartments, and passage means formed in the partition in spaced relation to said impeller means for establishing a flow path through each of the two compartments along which the liquid flows in opposite directions relative to the plate cathodes.

7. The improvement as defined in claim 4 wherein the detector means includes two comparator devices connected to the other of the first mentioned electrodes for alternatively generating the switching signal in response to a change in the plating current through the liquid approaching said threshold condition.

8. The combination of claim 7 wherein said electrodes include removable plate cathodes on which the metal is plated.

9. The combination of claim 8 wherein the liquid is enclosed within a container having a partition separating two compartments, the first mentioned and secondary electrodes being respectively suspended within the two compartments, and passage means formed in the partition in spaced relation to said impeller means for establishing a flow path through each of the two compartments along which the liquid flows in opposite directions relative to the plate cathodes.

10. In combination with apparatus for recovering metal from a body of electrolytic liquid conducting plating current therethrough between electrodes including current control means connected to one of the electrodes for changing said plating current supplied thereto from a voltage source, the improvement comprising resistor means connected in series with the electrodes for establishing a theshold potential on the other of the electrodes dependent on resistance characteristics of the liquid under a predetermined threshold condition, voltage selection means connected to said source for producing a reference potential substantially matching said threshold potential, detector means connected to said other of the electrodes and the voltage selection means connected to said other of the electrodes and the voltage selection means for generating a switching signal in response to approach of the liquid to said predetermined threshold condition, and means coupling the detector means to the current control means for prolonging recovery of the metal by corrective change in the plating current in response to said generation of the switching signal, the detector means including two comparator devices connected to the other of the electrodes for alternatively generating the switching signal in response to a change in the plating current through the liquid approaching said threshold condition.

11. In combination with apparatus for recovering metal from a body of electrolytic liquid conducting plating current therethrough between a primary cathode and anode, including a secondary cathode and anode connected in parallel with the primary cathode and anode, a container enclosing the liquid having a partition separating two compartments within which the primary and secondary cathodes and anodes are suspended, respectively, impeller means for inducing flow of the liquid sequentially through the two compartments, passage means formed in the partition in spaced relation to said impeller means for establishing a flow path through each of the two compartments along which the liquid flows in opposite directions relative to the cathodes and current control means connected to each of the anodes for changing the plating current.

12. The combination of claim 11 further including resistor means connected in series with the cathodes for establishing a threshold potential dependent on resistance characteristics of the liquid under a predetermined threshold condition, voltage selection means for producing a reference potential substantially matching said threshold potential, detector means connected to the primary cathode and the voltage selection means for generating a switching signal in response to approach of the liquid to said predetermined threshold condition, and means coupling the detector means to the current control means for prolonging recovery of the metal by corrective change in the plating current in response to said generation of the switching signal.

13. In combination with an electrolytic silver recovery apparatus having a liquid enclosing tank, a source of plating voltage, an electrode assembly suspended within the tank and power driven impeller means supported within the tank for inducing movement of liquid relative to the electrode assembly, the improvement residing in said electrode assembly including a primary cathode plate on which silver is electrolytically deposited, means removably mounting the cathode plate in fixed position within the tank, a plurality of spaced anodes fixedly mounted in spaced relation to the cathode plate and means mounting the impeller means in operative relation to the cathode plate for flow of the liquid along a predetermined path through the tank in opposite directions relative to the cathode plate.

14. The improvement as defined in claim 13 wherein said cathode plate and the anodes have an anode to cathode surface area ratio approximately between 0.87 and 2.35 to enable optimum silver extraction from the liquid between predetermined silver ion concentration limits.

15. The improvement as defined in claim 14 including means for partitioning the tank into at least two compartments through which the liquid passes in sequence, the primary cathode plate and anodes being enclosed within one of the compartments, the electrode assembly further including secondary electrodes enclosed within the other of the compartments.

16. The improvement as defined in claim 13 including means for partitioning the tank into at least two compartments through which the liquid passes in sequence, the primary cathode plate and anodes being enclosed within one of the compartments, the electrode assembly further including secondary electrodes enclosed with the other of the compartments.

17. In a control circuit for an electrolytic device having an anode, a cathode and an electrolyte to be processed, including a power source, controller means coupling the power source to the anode for applying a plating voltage across the anode and the cathode and sensing means connected to the cathode for measuring the potential thereon, the improvement comprising calibrating means connected to the power source for establishing threshold limits selected to correspond with the electrolyte to be processed, means connected to the sensing means and the calibrating means for comparing the measured cathode potential with the threshold limits and means coupling the comparing means with the controller means for changing the plating voltage in response to said cathode potential exceeding the threshold limits established by the calibrating means.

* * * * *